US006533713B1

(12) United States Patent
Borgstrom et al.

(10) Patent No.: US 6,533,713 B1
(45) Date of Patent: Mar. 18, 2003

(54) ENTRAINING DEVICE FOR A CENTRIFUGAL SEPARATOR

(75) Inventors: Leonard Borgstrom, Tyreso (SE); Claes Goran Carlsson, Tullinge (SE); Peter Franzen, Tullinge (SE); Claes Inge, Saltsjo-Duvnas (SE); Torgny Lagerstedt, Stockholm (SE); Hans Moberg, Stockholm (SE); Stefan Szepessy, Stockholm (SE); Mikael Sundstrom, Stockholm (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/763,095

(22) PCT Filed: Aug. 18, 1999

(86) PCT No.: PCT/SE99/01391

§ 371 (c)(1),
(2), (4) Date: Apr. 4, 2001

(87) PCT Pub. No.: WO00/10714

PCT Pub. Date: Mar. 2, 2000

(30) Foreign Application Priority Data

Aug. 20, 1998 (SE) ..... 9802784

(51) Int. Cl.[7] ..... B04B 1/08; B04B 7/12
(52) U.S. Cl. ..... 494/66; 494/67; 494/70
(58) Field of Search ..... 494/44, 53–54, 494/66–74, 79

(56) References Cited

U.S. PATENT DOCUMENTS

| | | | | |
|---|---|---|---|---|
| RE11,440 | E | * | 9/1894 | Malmros |
| 780,444 | A | | 1/1905 | Pihl |
| 1,277,676 | A | * | 9/1918 | Wright |
| 1,351,198 | A | | 8/1920 | Anderson |
| 1,648,790 | A | * | 11/1927 | Sturgeon |
| 1,906,457 | A | * | 5/1933 | Flowers |
| 2,311,606 | A | * | 2/1943 | Bannister |
| 2,662,687 | A | * | 12/1953 | Spross |
| 2,668,008 | A | * | 2/1954 | Spross |
| 3,231,182 | A | * | 1/1966 | Downey |
| 3,235,174 | A | * | 2/1966 | Downey |
| 3,990,631 | A | * | 11/1976 | Schall |
| 4,701,158 | A | | 10/1987 | Inge et al. |
| 4,721,505 | A | | 1/1988 | Inge et al. |
| 5,045,049 | A | * | 9/1991 | Lantz |
| 5,052,996 | A | | 10/1991 | Lantz |
| 5,362,292 | A | * | 11/1994 | Borgstrom et al. |
| 5,720,705 | A | * | 2/1998 | Inge et al. |

FOREIGN PATENT DOCUMENTS

| | | |
|---|---|---|
| DE | 159936 | 4/1905 |
| DE | 3041210 | 11/1980 |
| WO | WO 95/12082 | 5/1995 |
| WO | WO 97/17139 | 5/1997 |

* cited by examiner

*Primary Examiner*—Charles E. Cooley
(74) *Attorney, Agent, or Firm*—McCormick, Paulding & Huber LLP

(57) ABSTRACT

The invention is an entrainment device for a centrifugal separator. The entrainment device is comprised of two axial delimiting surfaces. One axial delimiting surface turns axially towards and the other turns axially away form an inlet chamber outlet of the separator. The entrainment device permits extended periods of operation without clogging of inlet chamber.

8 Claims, 1 Drawing Sheet

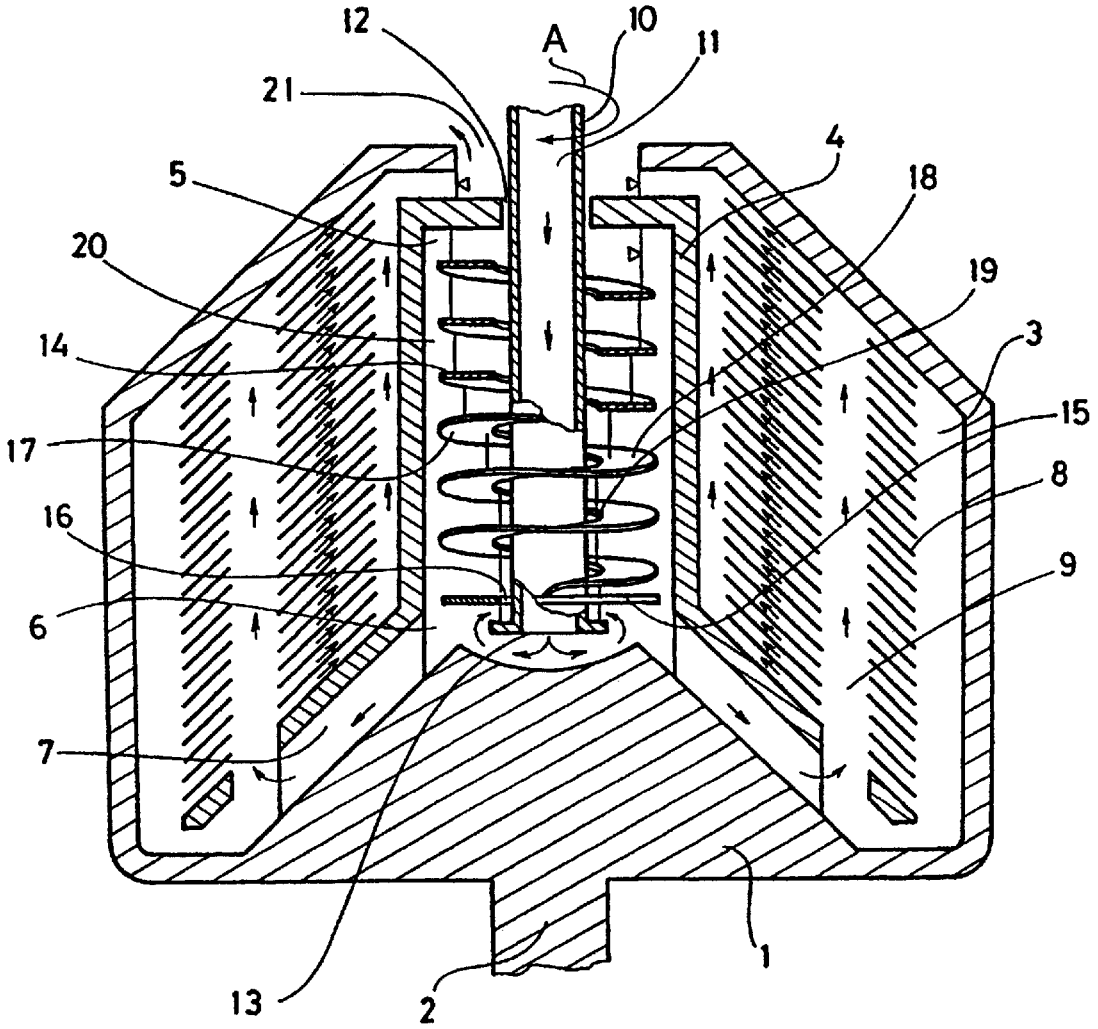
12
A
10
11
21
4
5
18
20
19
14
3
15
17
8
16
9
6
7
13
2
1

ENTRAINING DEVICE FOR A CENTRIFUGAL SEPARATOR

CROSS-REFERENCE TO RELATED APPLICATIONS

The present application is a United States National Stage application based on International Application No. PCT/SE99/01391, filed on Aug. 18, 1999, entitled "Entraining Device for a Centrifugal Separator", and claiming priority to Swedish Patent Application No. 9802784-0, filed on Aug. 20, 1998. Both PCT/SE99/01391 and Swedish Patent Application No. 9802784-0 are incorporated by reference herein.

BACKGROUND OF THE INVENTION

The present invention concerns an entraining device for a centrifugal separator having a rotor rotatable around a rotational axis. The rotor forms an inlet chamber in which an inlet tube opens for the supply during operation of a mixture of components to be separated. The inlet chamber has an outlet opening at a certain axial position in the inlet chamber. The rotor also forms a separation chamber that communicates with the outlet opening of the inlet chamber via at least one flow channel but otherwise is separated from the inlet chamber by a partition wall, which surrounds the rotational axis and has an axial extension the inside of which delimits the inlet chamber radially outwardly. Furthermore, the rotor forms at least one outlet for a component of the mixture separated during operation.

The entraining device is arranged in the inlet chamber fixedly connected, directly or indirectly, to the rotor. The entraining device extends axially along substantially all the axial length of the inlet chamber and comprises at least one liquid conducting element having two axial delimiting surfaces. One axial delimiting surface turns axially towards and the other turns axially away from the inlet chamber outlet. The entraining device extends radially and circumferentially in the inlet chamber and is at least partly located in a portion of the inlet chamber that during operation is filled with the mixture. The entraining device has a radial inner edge over which the mixture can flow during operation when the mixture level in the inlet chamber is located radially inside this edge and at least one flow passage arranged in the inlet chamber nearby the radial inside of the partition wall.

In each one of the following U.S. Pat. No. 4,701,158, U.S. Pat. No. 4,721,505 and WO-A-95/12082 there is disclosed a centrifugal separator, that has an entraining device. The entraining device is of the kind in which the inlet chamber is in the form of a number of discs that surrounds the rotational axis. The discs extend radially and circumferentially defining between themselves interspaces through which the mixture flows radially outwardly.

Due to the fact that the entraining devices in these centrifugal separators have large contact surfaces, which during operation entrain the supplied liquid mixture into the rotation of the rotor and which extend radially and in the circumferential direction, the entrainment takes place gently along these large surfaces. The higher the flow of the mixture supplied to these centrifugal separators, the more discs that attend automatically to the increased need of entrainment, as the mixture overflows the radial inner edges of even more discs. However, when the flow of the mixture is low, the mixture does not flow radially outwardly in all interspaces, which means that there is no axial flow along a portion of the insides of the partition walls, which delimits the inlet chambers radially outwardly towards the separation chambers.

In many cases, this means that sludge particles are deposited on the inside of the partition walls. Since there is no space in these centrifugal separators to design the inside of the partition walls with such a large angle relative to the rotational axis, these sludge particles can slip due to the centrifugal force along the inside of the partition walls towards the outlet openings of the inlet chambers. When this occurs the sludge particles will accumulate on of the inside of the partition walls. If this is allowed to continue, the inlet chambers eventually will become clogged. When clogging occurs, the centrifugal separation has to be interrupted for cleaning of the centrifugal separator.

In DE-C-30 41 210 and WO-A-97/17139, proposals are disclosed for cleaning the interior of the centrifugal separator. However, in the two proposals, the centrifugal separation has to be interrupted and valuable production time is lost. In many cases, you cannot get the centrifugal separator clean enough by the proposed methods, and the centrifugal separator still has to be disassembled, cleaned and re-assembled, which is a very labor intensive and time-consuming operation.

The object of the present invention is to design an entraining device for a centrifugal separator, which entrains the mixture, and which makes it possible to operate the centrifugal separator during long periods of time without the inlet chamber becoming clogged.

SUMMARY OF THE INVENTION

According to the present invention, the above-described object is in one aspect accomplished by one of the delimiting surfaces turning away from the outlet opening of the inlet chamber. As stated earlier, the delimiting surface turning away from the outlet opening of the inlet chamber comprises a surface portion, which during operation is at least partly located in a part of the inlet chamber that is filled with a mixture, and which in the circumferential direction extends axially in such a way that the delimiting surface seen in the rotational direction extends towards the outlet opening of the inlet chamber. In other words, the delimiting surface turning away from the outlet opening of the inlet chamber has a normalcy that has a component in the rotational direction.

In one embodiment of the invention, the axial extension in the circumferential direction is more than 0.5 mm but less than 100 mm.

In another embodiment of the invention, the surface portion consists of the entire delimiting surface, which is turned axially away from the outlet opening of the inlet chamber and that the axial extension of it in the circumferential direction is the same all along this delimiting surface.

In a further embodiment of the invention the two delimiting surfaces are substantially planar. Suitably, the two delimiting surfaces are parallel.

In a preferred embodiment of the invention, the delimiting surfaces extend in the circumferential direction in a helically shaped path at least one revolution around the rotational axis.

Preferably, the flow passage is annular surrounding the rotational axis.

In still another embodiment of the invention the inlet chamber has an axial end, in which the inlet tube opens and in which the outlet opening is located.

In the following, the invention is described more closely with reference to the attached drawing, in which the figure shows one embodiment of an entraining device according to the invention in a centrifugal separator.

DETAILED DESCRIPTION OF THE PREFERRED EMBODIMENTS

The section of a part of a centrifugal separator schematically shown in the figure has a rotorbody 1, which is supported by a driving shaft 2. Inside itself the rotorbody 1 forms a separation chamber 3. Centrally in the rotorbody 1 a wall element is arranged that forms a partition wall 4 and together with parts of the rotorbody 1 delimits an inlet chamber 5. The inlet chamber 5 has outlet openings 6 shown in the illustrated embodiment in its lower axial end and communicates with the separation chamber 3 via flow channels 7, which are formed between the partition wall 4 and the rotorbody 1. In the separation chamber 2, a stack of frusto-conical separation discs 8 is arranged. The discs 8 divide the separation chamber 3 into a number of interspaces, in which the main separation takes place. Axially through the stack of separation discs 8, a number of passages 9 extend that are formed by holes in the stack of separation discs 8 positioned one above the other.

As shown in the figure a stationary inlet tube 10 with an internal inlet channel 11 extends axially through a central opening in the rotorbody 1 into the rotor and further through a central opening 12 in the partition wall 4 into the inlet chamber 5. The inlet channel 11 has an opening 13, which is located in the illustrated embodiment at the lower axial end of the inlet chamber 5. In the inlet chamber an entraining device 14 according to the present invention is arranged fixedly connected to a part rotating with the rotor. This part can be the partition wall 4 or the rotorbody 1. The entraining device 14 extends axially in the inlet chamber 5 along substantially all the inlet chamber's 5 length between the opening 13 of the inlet channel 11 and the opposite axial end of the inlet chamber 5. Closest to the opening 13 of the inlet channel 11, the entraining device 14 is provided with an annular disc 15 that surrounds the inlet tube 10 leaving a gap 16 between itself and the inlet tube 10.

The embodiment of an entraining device 14 according to the invention shown as an example in the figure is delimited axially by two delimiting surfaces 17 and 18. One delimiting surface 17 turns toward and the other delimiting surface 18 turns away from the outlet opening 6 of the inlet chamber 5. The delimiting surfaces 17 and 18 extend radially and in the circumferential direction around the inlet tube 10 and the rotational axis. The entraining device 14 is located during operation at least partly in a portion of the inlet chamber 5 that is filled with the mixture. The entraining device 14 has a radial inner edge 19, that turns towards the inlet tube and surrounding the rotational axis enabling the mixture during operating to flow over the edge, when the mixture level, which in the figure is marked with a triangle, in the inlet chamber 5 is located radially inside the radial inner edge 19. An annular flow passage 20, surrounding the rotational axis, is arranged between the entraining device 14 and the partition wall.

The centrifugal separator schematically shown in FIG. 1 is provided with an outlet 21 in the form of an overflow outlet for a separated specific lighter component of the mixture.

The two delimiting surfaces 17 and 18 in the embodiment shown in FIG. 1 have a surface portion, which during operation is at least partly located in a mixture filled portion of the inlet chamber 5. The two delimiting surfaces 17 and 18 in the circumferential direction extend axially in such a way that the surface portion seen in the rotational direction extends in a direction towards the inlet opening of the inlet chamber. In the shown example, all of the delimiting surfaces 17 and 18 extend axially in the circumferential direction in such a way that when seen in the rotational direction extend towards the outlet opening 6 of the inlet chamber 5. Furthermore, the two delimiting surfaces 17 and 18 are substantially planar and parallel and extend in a helically shaped path several revolutions around the rotational axis.

The entraining device 14 for a centrifugal separator shown in the figure operates in the following manner:

While the rotorbody 1 is rotating in a direction generally indicated by the arrow labeled "A" in the sole figure, the mixture of components to be separated enters the inlet tube 10 and is supplied through the inlet channel 11 an is discharged therefrom to the inlet chamber 5. The entering mixture fills up the inlet chamber's lower part radially inwardly and eventually the mixture flows through the gap 16 between the stationary inlet tube 10 and the annular disc 15 of the entraining device 14, where it comes in contact with the delimiting surfaces 17 and 18. The delimiting surfaces 17 and 18 act to entrain the mixture. The mixture, which has not yet obtained the rotational speed of the rotor 1 is moving opposite to the rotational direction of the delimiting surfaces 17 and 18 that form part of the entraining device 14 and rotate therewith. At least a portion of the mixture flowing into the inlet chamber 5 flows through the gap 16, through the rotating entraining device 14 and through flow passage 20 before it flows out to the separation chamber 3, where the main separation takes place. Rotation of the entraining device 14 and thereby the delimiting surfaces 17 and 18 urge the flow of mixture axially upward with the inlet chamber 5. At least a portion of the mixture subsequently travels radially outward and into the annular flow passage 20, prior to traveling axially within the inlet chamber 5 toward the outlet openings 6, and into the separation chamber 3.

At a certain flow of the mixture to the centrifugal separator, the free mixture surface of the rotating liquid body in the inlet chamber 5 will be positioned as illustrated by the continuous line and the little triangle shown in the figure. If the flow of the mixture increases, the mixture surface gradually will be so displaced that the mixture will pass through more and more axial interspaces between the revolutions of the delimiting surfaces 17, 18 within the entraining device 14.

By designing a centrifugal separator in this way a mixture can be entrained efficiently and gently while at the same time avoiding the problem of having the inlet chamber clog.

In the embodiment shown in the figure the entraining device 14 is shown with one single helically shaped element 14. The entraining device 14 can, of course, be provided with more helically shaped elements or be composed by a number of elements distributed axially around the rotational axis. As a suggestion these might be shaped as vanes.

In the shown example the axial extension of the delimiting surfaces is constant but can also vary by the distance to the outlet opening.

In the shown example, the invention is used in a centrifugal separator having a vertical shaft but can, of course, also be used in centrifugal separators having a horizontal driving shaft such as in decanters.

What is claimed is:

1. An entraining device for a centrifugal separator having a rotor rotatable around a rotational axis, the rotor including:

an inlet chamber (5), in which an inlet tube (10) opens for the supply, during operation, of a mixture of components to be separated, the inlet chamber (5) having an outlet opening (6) at a certain axial position in the inlet chamber (5), a separation chamber (3), which communicates with the outlet opening (6) of the inlet chamber (5) via at least one flow channel (7) but otherwise is separated from the inlet chamber (5) by means of a partition wall (4), wherein the partition wall surrounds the rotational axis and has an axial extension and an inside which delimits the inlet chamber radially outwardly, at least one outlet (21) for a component separated during operation, an entraining device positioned within the inlet chamber (5) fixedly connected to a part rotating with the rotor and extending axially along substantially all the axial length of the inlet chamber (5) and comprising at least one mixture conducting element having a first and a second axial delimiting surface (17, 18), the first axial delimiting surface (17) being turned axially towards and the second axial delimiting surface (18) being turned axially away from the outlet opening (6) of the inlet chamber (5), and the first and second axial delimiting surfaces (17, 18) extending radially and circumferentially in the inlet chamber (5) and being at least partly located in a part of the inlet chamber (5) that during operation is filled up with the mixture, the liquid conducting element having a radial inner edge (19) over which the mixture can flow during operation when the level of the mixture in the inlet chamber (5) is located radially inside the radial inner edge (19) and at least one flow passage (20) being arranged in the inlet chamber (5) nearby the radial inside of the partition wall (4), and wherein the second axial delimiting surface (18) comprises a surface portion, which during operation at least partly is located in a part of the inlet chamber (5) that is filled up with liquid, and which in circumferential direction extends axially such that the surface portion seen in the rotational direction extends towards the outlet opening (6) of the inlet chamber (5).

2. An entraining device according to claim 1, wherein the axial extension in the circumferential direction is more than 0.5 mm but less than 100 mm.

3. An entraining device according to claim 1, wherein said surface portion includes the entire second axial delimiting surface (18) and that the axial extension in the circumferential direction is the same all along the second axial delimiting surface (18).

4. An entraining device according to claim 3, wherein the first and second delimiting surfaces (17, 18) are substantially planar.

5. An entraining device according to claim 3, wherein the first and second delimiting surfaces (17, 18) extend in the circumferential direction in a helically shaped path at least one revolution around the rotational axis.

6. An entraining device according to claim 1, wherein the first and second delimiting surfaces (17, 18) are approximately parallel.

7. An entraining device according to claim 1, wherein the flow passage is annular and surrounds the rotational axis.

8. An entraining device according to claim 1, wherein the entraining device is arranged to entrain the mixture in the inlet chamber (5) having an axial end into which the inlet tube (10) opens and in which the outlet opening (6) is located.

* * * * *